US007525250B2

(12) United States Patent
Eom

(10) Patent No.: US 7,525,250 B2
(45) Date of Patent: Apr. 28, 2009

(54) PLASMA DISPLAY PANEL

(75) Inventor: Ki-Jong Eom, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 536 days.

(21) Appl. No.: 11/205,259

(22) Filed: Aug. 15, 2005

(65) Prior Publication Data

US 2006/0097634 A1 May 11, 2006

(30) Foreign Application Priority Data

Nov. 9, 2004 (KR) ..... 10-2004-0090843

(51) Int. Cl.
*H01J 1/62* (2006.01)

(52) U.S. Cl. ..... 313/582; 313/584

(58) Field of Classification Search ..... 313/582–586
See application file for complete search history.

(56) References Cited

U.S. PATENT DOCUMENTS 6,348,762 B1 2/2002 Nunomura et al.
7,196,470 B2 * 3/2007 Yoo et al. ..... 313/582
2008/0067934 A1 * 3/2008 Kim et al. ..... 313/582

FOREIGN PATENT DOCUMENTS

KR 1998-043083 8/1998
KR 1999-017001 3/1999
KR 2003-0084384 11/2003

OTHER PUBLICATIONS

Korean Patent Abstracts, Publication No. 1019980043083, dated Aug. 17, 1998 in the name of Guang-Sup Cho.
Korean Patent Abstracts of Publication of Application No. 1019970039735 corresponds to Application No. 1999-01 7001 listed above.
Korean Patent Abstracts, Publication No. 1020030084384 A, dated Nov. 1, 2003 in the name of Byeong Guk Min.

* cited by examiner

*Primary Examiner*—Vip Patel
(74) *Attorney, Agent, or Firm*—Christie, Parker & Hale, LLP

(57) ABSTRACT

A plasma display panel has an improved display electrode, thereby enhancing emission luminance. The plasma display panel includes a front substrate and a rear substrate that face each other and between which a space is formed, barrier ribs that define a plurality of discharge cells in the space between the front substrate and the rear substrate, address electrodes that extend in a first direction to intersect the discharge cells, phosphor layers that are respectively formed within the discharge cells, and first electrodes and second electrodes having linear portions that are formed in a second direction to intersect the first direction and protruded portions that extend in the first direction from the linear portions and face each other in the second direction within the discharge cells so as to form discharge gaps, respectively.

21 Claims, 8 Drawing Sheets

PLASMA DISPLAY PANEL

CROSS-REFERENCE TO RELATED APPLICATION

This application claims priority to and the benefit of Korean Patent Application No. 10-2004-0090843, filed in the Korean Intellectual Property Office on Nov. 9, 2004, the entire content of which is incorporated herein by reference.

BACKGROUND OF THE INVENTION

1. Field of the Invention

The present invention relates to a plasma display panel, and more particularly, a plasma display panel that has an improved structure of a display electrode to thereby enhance emission luminance.

2. Description of the Related Art

Generally, a plasma display panel (hereinafter, referred to as PDP) is a display device in which vacuum ultraviolet rays emitted from plasma through gas discharge excite phosphors to generate visible light, thereby realizing images. In a PDP, a large screen of 60 inches or more can be implemented to have a thickness of no more than 10 cm. Further, the PDP is a self-emitting device, like a cathode ray tube (CRT), and has a superior color reproduction capability, without a distortion due to viewing angle. In addition, with a simple manufacturing process, the PDP has an advantage over a liquid crystal display (LCD) or the like in view of productivity and cost and thus has been spotlighted as a next-generation industrial flat plate display and/or a home TV display.

Since the 1970's, the structure of a PDP has been evolving and, at present time, a three-electrode surface-discharge type structure is generally in use. In the three-electrode surface-discharge type structure, a front substrate has a pair of electrodes disposed on the same surface, a rear substrate is spaced at a predetermined distance away from the front substrate and has an address electrode extending to intersect (or cross-over/under) the pair of electrodes, and a discharge gas is sealed between the front and rear substrates.

In the PDP having the three-electrode surface-discharge type structure, a discharge cell to be turned on is first determined through the accumulation of wall charges on the address electrode, and a sustain discharge for displaying an emission luminance is then performed by the pair of electrodes formed on the front substrate.

In the PDP having the above structure, a discharge should be fired over a wide area, such that the discharge fired by the pair of electrodes is effectively diffused throughout the entire discharge cell. However, in the PDP according to a related art, the pair and address electrodes are disposed across the long sides of a planar-shaped discharge cell (for example, a rectangular shaped discharge cell) so as to face each other. Because of this, the discharge is fired partially along the short sides of the discharge cell and thus the discharge may not be diffused smoothly.

Also, the address electrode is made of a transparent electrode so as not to shield light from the front substrate. However, since the transparent electrode has high resistance, a metal electrode is formed on the transparent electrode in order to complement conductivity of the transparent electrode. Because light does not transmit through the metal electrode, the metal electrode is thus formed along an edge in a widthwise direction of the transparent electrode so as not to shield light from the discharge cell.

However, even when the transparent electrode and the metal electrode are formed together, the transparent electrode is disposed along the periphery of the discharge gap where the discharge occurs, which results in a high discharge firing voltage. Further, since the material (for example, indium tin oxide or ITO) for the transparent electrode is expensive, the manufacturing cost of the PDP is increased, so that the price competitiveness is lowered. Further, since the electrode formed in a strip shape on the substrate has a two-layer structure of the transparent electrode and the metal electrode, the manufacturing process is further complicated, which causes the manufacturing cost to be further increased.

On the other hand, the discharge occurring within the discharge cell is introduced by a dielectric layer, a phosphor layer, and a discharge gas between the address electrode and the pair of electrodes provided on the front substrate and thus the discharge is affected by the materials and shapes of these parts. In this case, the dielectric layer is formed to have a uniform thickness over (or under) the entire front substrate, and thus the difference in characteristic of the red, green, and blue discharge cells does not exist.

However, with regards to the phosphor layer having a blue phosphor material, such as barium-magnesium aluminate with Eu as the emission center ($BaMgAl_{10}O_{17}$:Eu), a green phosphor material, such as zinc silicate with Mn as the emission center ($Zn_2SiO_4$:Mn), and a red phosphor material, such as yttrium-gadolinium borate with Eu as the emission center ($Y_{0.35}Gd_{0.35}BO_3$:EU), $Y_2O_3$:Eu, or $Gd_2O_3$:Eu; the dielectric constants of the blue, green, and/or red phosphor materials are different. Further, when manufacturing the PDP, a substantial difference in thickness according to colors may occur. Accordingly, the difference in capacitance occurs due to the characteristics of the materials of the phosphor layer and the difference in thickness, which results in a problem in that the emission luminances of the red, green, and blue discharge cells are different from each other.

In particular, if the luminance of the blue discharge cell becomes low, the color temperature (or white balance) also becomes low, and thus the brightness of the PDP is perceived by human eyes to be relatively dark. For this reason, the white balance is adjusted through a gamma correction. In this case, since the luminance of blue discharge cell is relatively low, the white balance is adjusted on the basis of the luminance of blue discharge cell. Accordingly, the loss of the emission luminance occurs through the gamma correction by that amount corresponding to the difference in luminance of blue and red (or green) discharge cells.

SUMMARY OF THE INVENTION

An embodiment of the present invention provides a plasma display panel that has an improved electrode structure, thereby enhancing emission luminance and discharge efficiency.

An embodiment of the present invention provides a plasma display panel that uses an electrode made of a metal, thereby improving conductivity.

An embodiment of the present invention provides a plasma display panel that has an increased aperture ratio.

An embodiment of the present invention provides a plasma display panel that can structurally compensate for a difference in luminance of discharge cells for respective colors.

According to an embodiment of the present invention, a plasma display panel includes a front substrate and a rear substrate that face each other and between which a space is formed, barrier ribs that define a plurality of discharge cells in the space between the front substrate and the rear substrate, address electrodes that extend in a first direction to intersect the discharge cells, phosphor layers that are respectively formed within the discharge cells, and first electrodes and second electrodes having linear portions that are formed in a second direction to intersect the first direction and protruded portions that extend in the first direction from the linear portions and face each other in the second direction within the discharge cells so as to form discharge gaps, respectively.

In the plasma display panel according to one embodiment of the present invention, each of the protruded portions of the first electrodes and the second electrodes has a first portion that extends in the first direction from the linear portion and a second portion that extends to a pair of adjacent discharge cells in the second direction from the first portion.

The barrier ribs may have vertical barrier ribs that are formed in the first direction and horizontal barrier ribs that are formed in the second direction. Further, the first portions of the protruded portions may be formed above the vertical barrier ribs, respectively, and the linear portions may be formed above the horizontal barrier ribs, respectively.

The second portion of one of the protruded portions may have a first electrode portion that is spaced apart from the first portion thereof and that forms a respective one of the discharge gaps together with the second portion of another one of the protruded portion opposing the one of the protruded portions within a respective one of the discharge cells, and a second electrode portion that connects the first electrode portion to the first portion thereof.

An end of the first portion of the one of the protruded portions may be connected to the second electrode portion of the second portion thereof.

Further, the first electrode portion of the second portion of the one of the protruded portions may have a first concave portion by which the respective one of the discharge gap is formed into a first gap and a second gap having different sizes.

Further, the second portion of each of the protruded portions may have a rib that connects a pair of first electrode portions, respectively formed in the pair of adjacent discharge cells in the second direction, to each other. A pair of ribs may be formed in the second portion of the one of the protruded portions.

In the plasma display panel according to the one embodiment of the present invention, the protruded portions of the first electrodes and the protruded portions of the second electrodes are alternately disposed in the second direction.

In addition, each of the linear portions or each of the protruded portions may be made of a metal.

Further, each of the discharge cells may have a respective one of the phosphor layers representing one of first, second, and third colors, and the protruded portions of the first electrodes and the second electrodes corresponding to the discharge cells having the phosphor layer representing one of the colors may be formed to be larger than the protruded portions corresponding to other discharge cells representing other colors.

In one embodiment, the protruded portions corresponding to the discharge cells of the first color are formed to be larger than the protruded portions corresponding to the discharge cells of the second color and the third color, and the protruded portions corresponding to the second color and the third color have the same or substantially the same size.

Further, in one embodiment, the first color is blue.

Further, in one embodiment, the first color, the second color, and the third color are blue, green, and red, respectively.

In the plasma display panel according to one embodiment of the present invention, the second electrode portion may have a second concave portion that is concave inward, and the second concave portion may be connected to the end of the corresponding first portion. In one embodiment, the second concave portion is connected to the end of the corresponding first portion obliquely.

BRIEF DESCRIPTION OF THE DRAWINGS

The accompanying drawings, together with the specification, illustrate exemplary embodiments of the present invention and together with the description serve to explain the principles of the invention.

DETAILED DESCRIPTION

Figure 1:
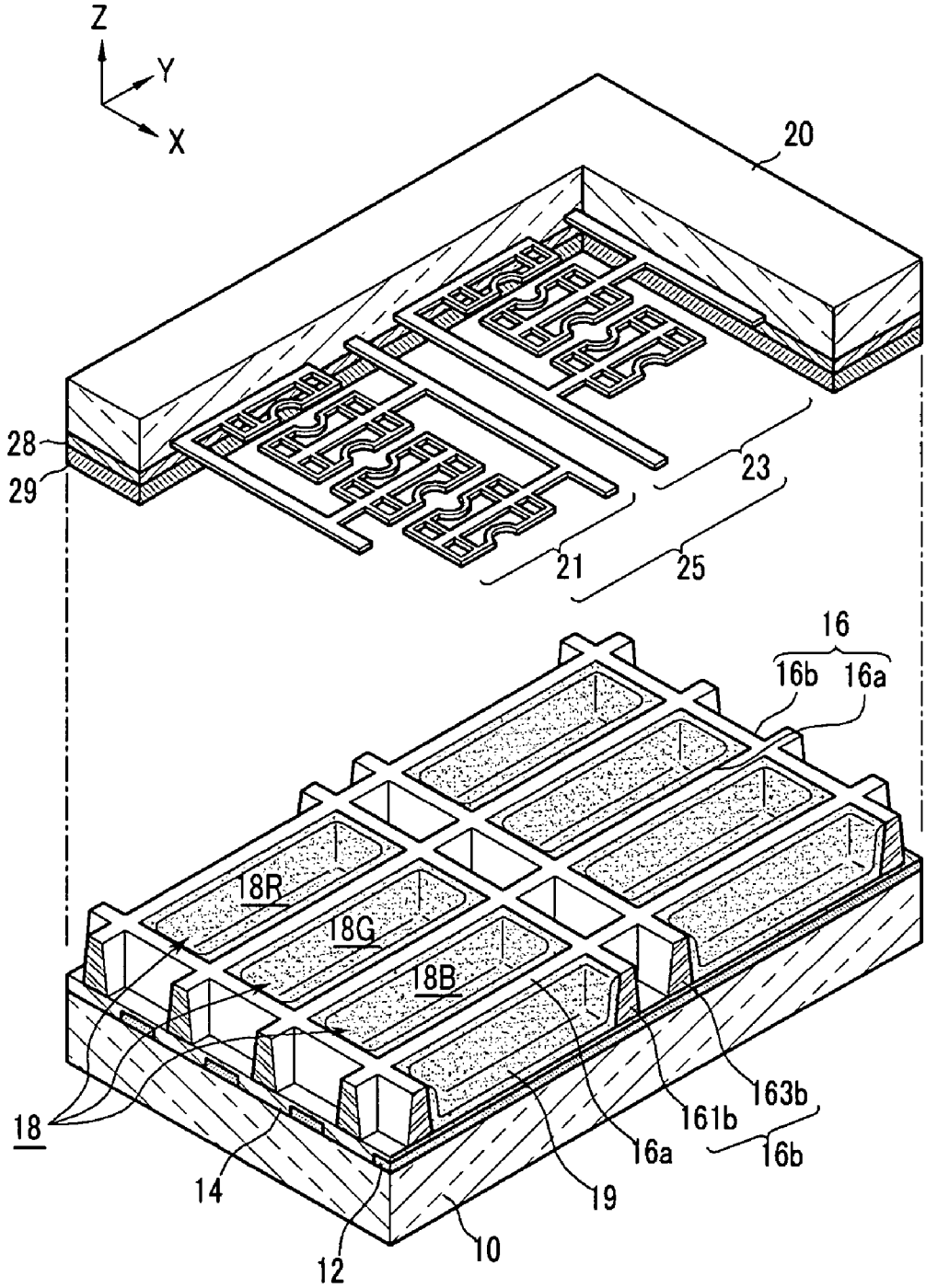
FIG. 1 is a partially exploded perspective view showing a plasma display panel according to a first embodiment of the present invention.

FIG. 1 is a partially exploded perspective view showing a plasma display panel according to a first embodiment of the present invention.

Referring to FIG. 1, the plasma display panel (hereinafter, referred to as PDP) according to the present embodiment includes a front substrate 20 and a rear substrate 10 that is disposed to face the front substrate 20.

The front substrate 20 is made of a transparent material, such as glass, through which a visible light beam transmits to display an image.

Display electrodes 25 are formed on the lower surface of the front substrate 20. In the present embodiment, the display electrodes 25 are geometrically formed in linear shapes in order to increase an aperture ratio of a discharge cell. The display electrodes 25 will be described below in more detail.

The display electrodes 25 may be covered and filled with a dielectric layer (or a first dielectric layer) 28 made of a dielectric material, such as PbO, $B_2O_3$, $SiO_2$, or the like. The dielectric layer 28 protects the display electrodes 25 from being damaged by the collision of charged particles with the display electrodes 25 at the time of the discharge and introduction of the charged particles.

Also, a protective film 29 made of a material, such as MgO, may be formed on the lower surface of the dielectric layer 28. The protective film 29 protects the dielectric layer 28 from being damaged by the collision of the charged particles with the dielectric layer 28 at the time of the discharge. When the charged particles collide with the protective film 29, secondary electrons are emitted therefrom, such that the discharge efficiency can be increased.

On the upper surface of the rear substrate 10 facing the front substrate 20, address electrodes 12 extend in a direction intersecting (or crossing-over/under) the display electrodes 25 and are disposed in stripe shapes to be spaced apart from one another. The address electrodes 12 are covered and filled with a dielectric layer (or a second dielectric layer) 14 and barrier ribs 16 are formed in a predetermined pattern on the dielectric layer 14.

The barrier ribs 16 are used to define discharge cells 18 into discharge spaces, where discharges are performed, and prevent crosstalk between adjacent discharge cells 18. As shown in FIG. 1, the barrier ribs 16 have vertical barrier ribs 16*a* that extend to be spaced apart from one another and horizontal barrier ribs 16*b* that extend in directions intersecting (or crossing) the vertical barrier ribs 16*a* on the same plane. In FIG. 1, the barrier ribs 16 have a closed structure and define the discharge cells 18 having rectangular shapes.

Here, the vertical barrier ribs 16*a* respectively extend in parallel with the address electrodes 12. One address electrode 12 is disposed between a pair of the vertical barrier ribs 16*a*. Further, as shown in FIG. 1, the horizontal barrier ribs 16*b* are spaced apart from one another to thereby form first and second horizontal barrier ribs 161 and 163 having a space therebetween. In FIG. 1, an area, including the space between the first and second horizontal barrier ribs 161 and 163, is a non-discharge area and acts as an exhaust passage. In the present embodiment, the barrier ribs 16 are not limited to the above-described structure, and various suitable structures may be used. For example, stripe-shape barrier ribs may be used, with no horizontal barrier ribs 16*b*.

Further, a phosphor layer 19 that is excited by ultraviolet rays generated at the time of the discharge so as to emit visible light is formed within the discharge cell 18. As shown in FIG. 1, the phosphor layer 19 is formed over the wall surfaces of the barrier ribs 16 and the upper surface of the dielectric layer 14 defined by the barrier ribs 16. The phosphor layer 19 may be made of any one of red, green, and blue phosphors for red, green, or blue color display. In FIG. 1, the discharges cells 18 include red discharge cells 18R, green discharge cells 18G, and blue discharge cells 18B.

Within the discharge cells 18 in which the phosphor layer 19 is disposed, a discharge gas, which is obtained by mixing Ne, Xe, or the like, is filled.

In the PDP of the present embodiment, a display electrode 25 has a pair of a first electrode 21 (hereinafter, referred to as a scan electrode) and a second electrode 23 (hereinafter, referred to as a sustain electrode). The pair of the first electrode 21 and the second electrode 23 face each other within the discharge cell. More specifically, the scan electrode 21 and the sustain electrode 23 face each other along the long side in the planar shape of the discharge cell 18 (in FIG. 1, a y-axis direction) so as to form a discharge gap G (see FIG. 2). Here, the scan electrode 21 selects a discharge cell to be turned on in combination with the address electrode 12 and the sustain electrode 23 sustains and discharges the selected discharge cell in combination with the scan electrode 21.

Figure 2:
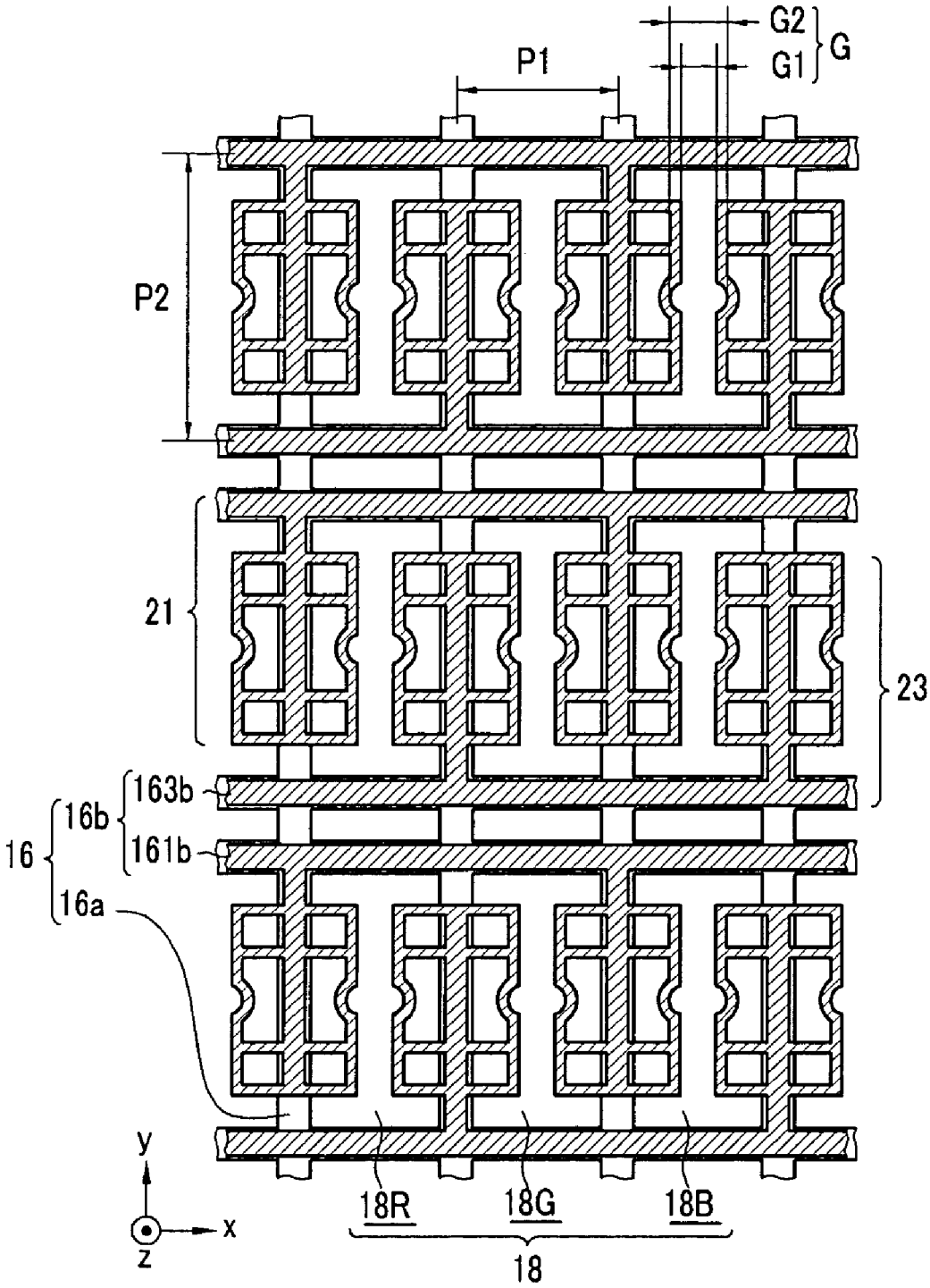
FIG. 2 is a plan view illustrating the positional relationship between display electrodes and barrier ribs of the first embodiment.
Figure 3:
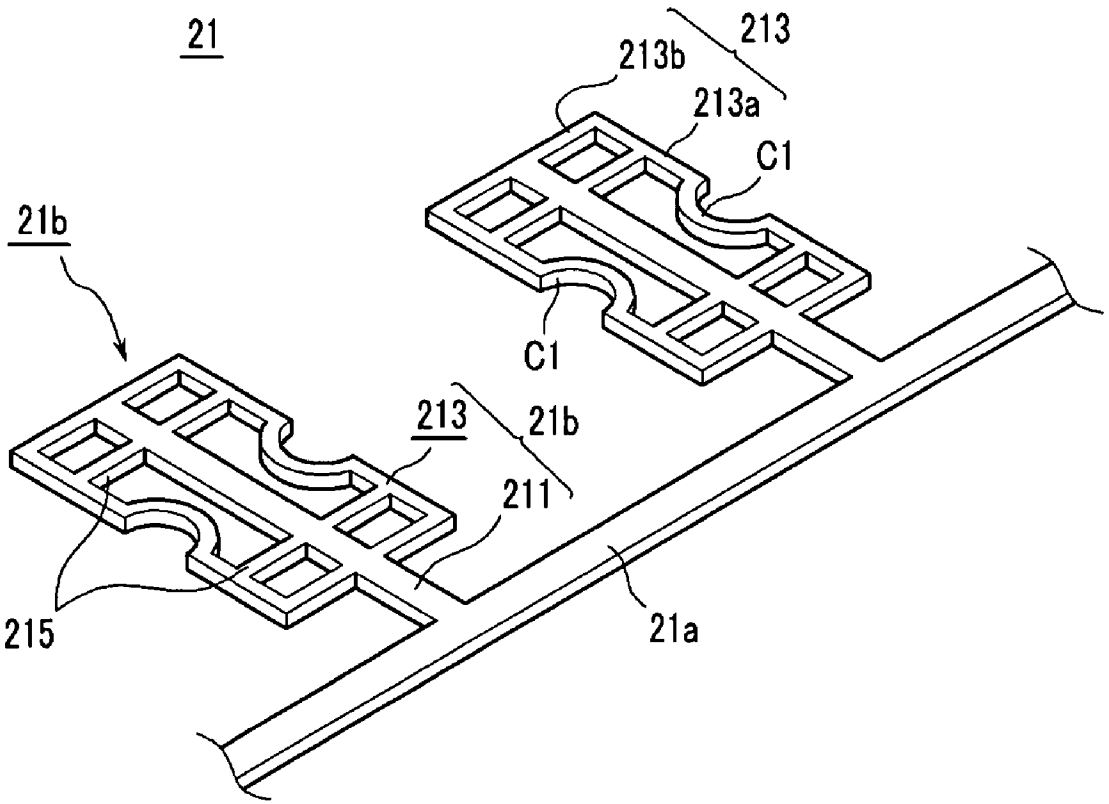
FIG. 3 is a perspective view showing scan electrodes of the display electrodes of the first embodiment.
Figure 4:
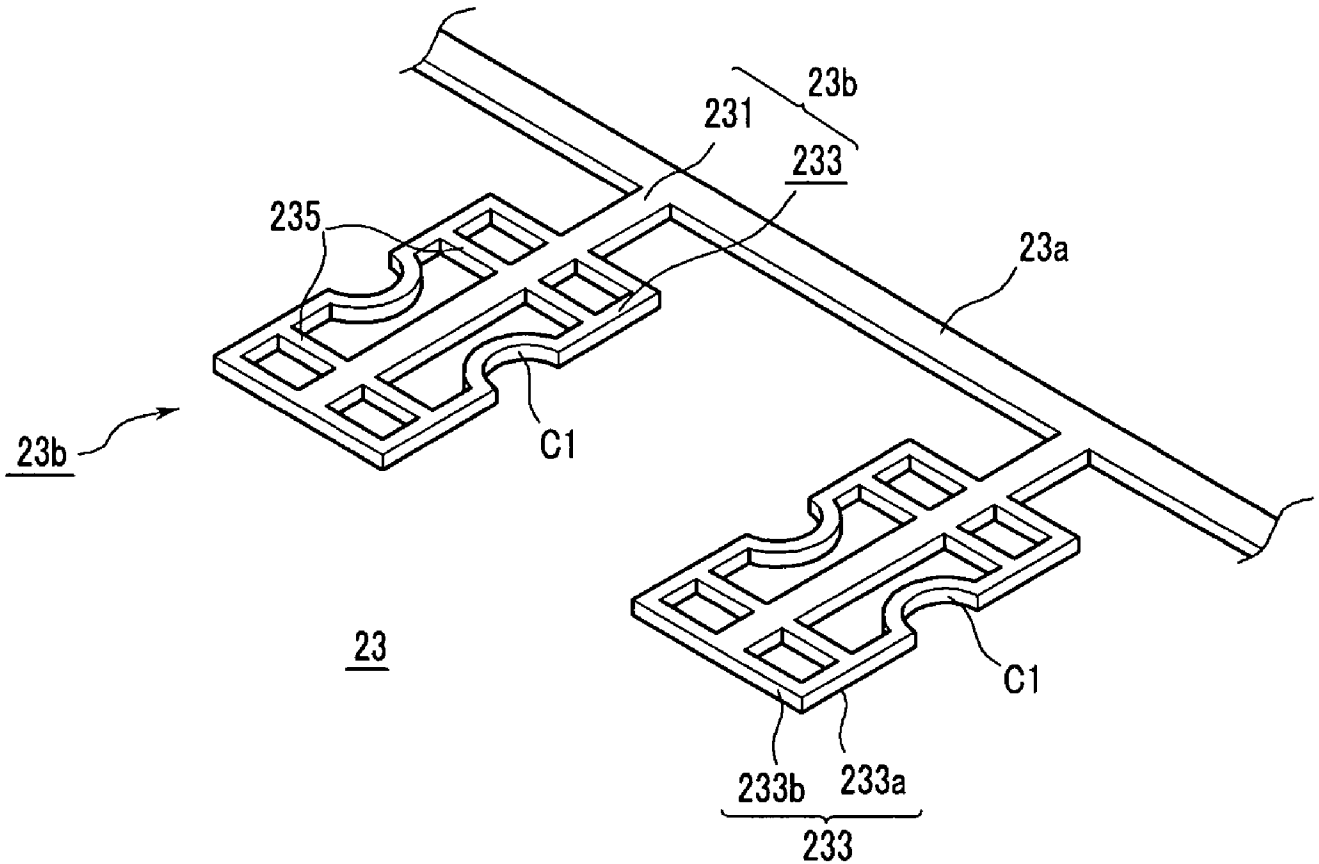
FIG. 4 is a perspective view showing sustain electrodes of the display electrodes of the first embodiment.

A display electrode (e.g., the display electrode 21) of the present embodiment will be described in more detail with reference to FIGS. 2, 3, and 4. FIG. 2 is a diagram showing an arrangement relationship between the display electrodes and the barrier ribs. FIGS. 3 and 4 are perspective views showing the scan electrodes and the sustain electrodes constituting the display electrodes.

As shown in FIGS. 2, 3, and 4, the scan electrode 21 of the display electrode 25 of the present embodiment includes a linear portion 21*a* and a protruded portion 21*b* that extends from the linear portion 21*a*.

The linear portion 21*a* is formed in the extension direction of the horizontal barrier rib 16*b* (in FIG. 2, an x-axis direction). In one embodiment, the linear portion 21*a* is formed above the horizontal barrier rib 16*b*. Further, the linear portion 21*a* has a slender and long linear shape.

The protruded portion 21*b* has a first portion 211 that extends in the extension direction of the vertical barrier rib 16*a* (in FIG. 2, a y-axis direction) from the linear portion 21*a* and a second portion 213 that extends respectively to a pair of adjacent discharge cells 18 in the extension direction of the horizontal barrier rib 16*b* from the first portion 211 so as to have a substantially ring (or connected) shape (or a substantially ring-shaped configuration).

The first portion 211 is in one embodiment formed above the vertical barrier rib 16*a* and has a slender and long linear shape.

Also, the second portion 213 is spaced apart from the first portion 211 inside the discharge cell. The second portion 213 has a first electrode portion 213*a* that faces a second portion 233 constituting the sustain electrode 23 in the discharge cell to form the discharge gap G, and a second electrode portion 213*b* that connects the first electrode portion 213*a* to the first portion 211. In one embodiment, the first portion 211 extends from the linear portion 21*a* such that an end thereof is connected to the second electrode portion 213*b*.

Further, the second portion 213 of the protruded portion 21*b* has a rib 215 that connects a pair of first electrode portions 213*a* in adjacent discharge cells to each other. In this case, a pair of ribs 215 is shown in FIG. 3 to be formed in the second portion 213.

The scan electrode 21 having such a configuration is in one embodiment made of a metal having high conductivity, such as chromium, copper, or the like.

On the other hand, at an opposite side to the scan electrode 21 in the discharge cell, the sustain electrode 23 having substantially the same configuration and shape as those of the scan electrode 21 is disposed.

That is, as shown in FIG. 4, the scan electrode 23 includes a linear portion 23*a* and a protruded portion 23*b*.

The linear portion 23*a* is formed in the extension direction of the horizontal barrier rib 16*b* (in the FIG. 2, the x-axis direction). In one embodiment, the linear portion 23*a* is formed above the horizontal barrier rib 16*b*. Further, the linear portion 23*a* has a slender and long linear shape.

The protruded portion 23*b* has a first portion 231 that extends in the extension direction of the vertical barrier rib 16*a* and a second portion 233 that extends respectively to a pair of adjacent discharge cells 18 in the extension direction of the horizontal barrier rib 16*b* so as to have a substantially ring (or connected) shape.

The first portion 231 is in one embodiment formed above the vertical barrier rib 16*a* and has a slender and long linear shape.

Also, the second portion 233 has a first electrode portion 233*a* that is spaced apart from the first portion 231 inside the discharge cell and that faces the second portion 213 constituting the scan electrode 21 in the discharge cell so as to form the discharge gap G, and a second electrode portion 233*b* that connects the first electrode portion 233*a* to the first portion 231. In one embodiment, the first portion 231 extend from the linear portion 23*a* such that an end thereof is connected to the second electrode portion 233*b*.

Further, the second portion 233 of the protruded portion 23*b* has a rib 235 that connects a pair of first electrode portions 233*a* in adjacent discharge cells to each other. In this case, a pair of ribs 235 is shown in FIG. 4 to be formed in the second portion 233.

The sustain electrode 23 having such a configuration is in one embodiment made of a metal having high conductivity, such as chromium, copper, or the like.

As described above, the sustain electrode 23 having substantially the same structure and shape as those of the scan electrode 21, the protruded portions 23*b* and 21*b* are disposed to face each other in the extension direction of the horizontal barrier rib (in FIG. 2, the x-axis direction) so as to form the discharge gap G.

Figure 5:
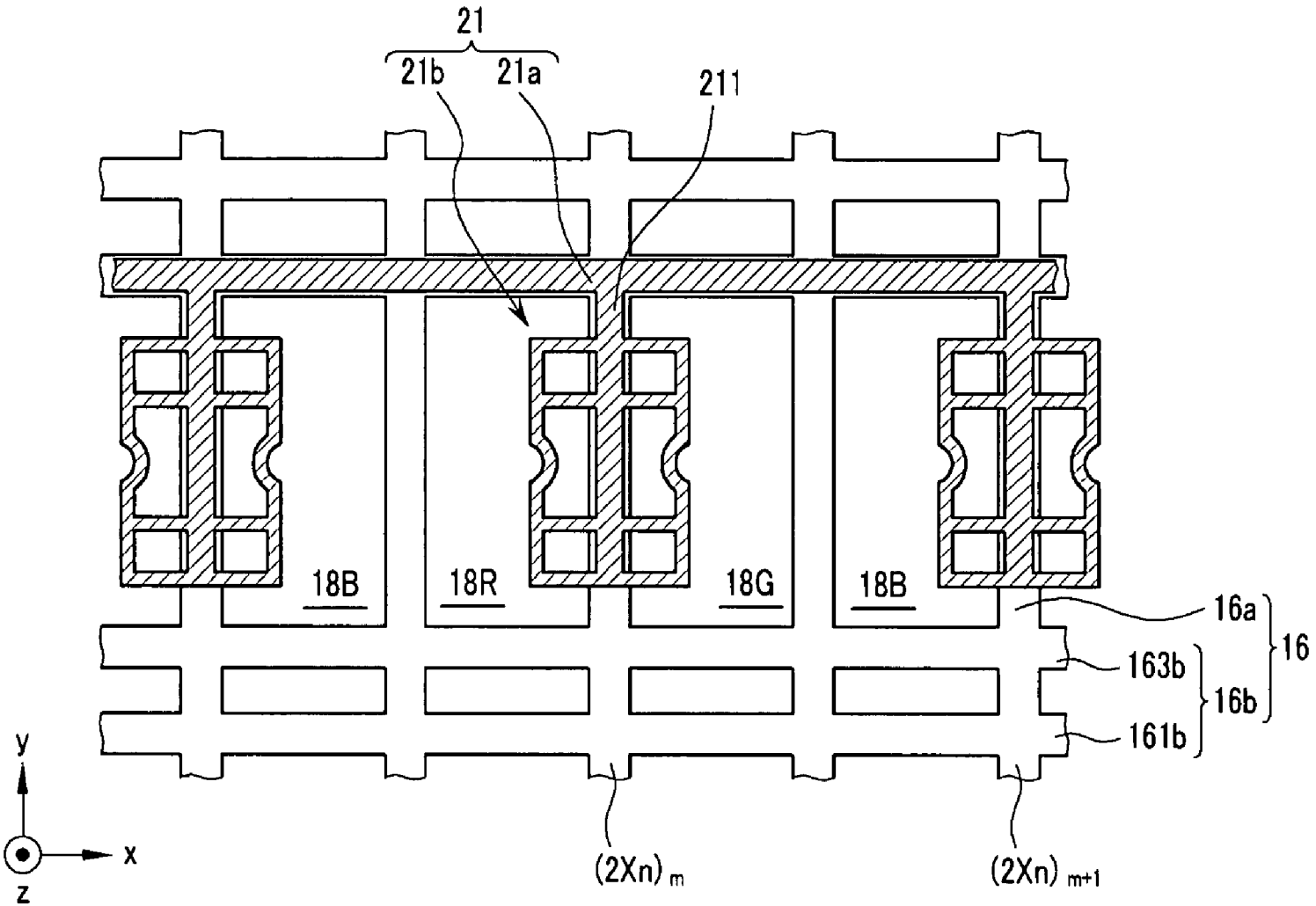
FIG. 5 is a plan view illustrating the positional relationship between the barrier ribs and the scan electrodes of the first embodiment.

FIG. 5 is a diagram illustrating the structure in which the protruded portions of the scan electrode are disposed along even-numbered vertical barrier ribs.

As shown in FIG. 5, a linear portion 21*a* constituting the scan electrode 21 is disposed immediately above a horizontal barrier rib 161*b* and the first portion 211 of the protruded portion 21*b* is disposed immediately above a vertical barrier rib 16*a*.

Accordingly, the scan electrode 21 is disposed in the discharge cell such that the protruded portions 21*b* thereof are respectively protruded to a pair of adjacent discharge cells in the extension direction of the horizontal barrier rib 16*b*.

In addition, a plurality of respective protruded portions 21*b* are formed to extend from the linear portion 21*a* corresponding to the even-numbered vertical barrier ribs 16*a*. Accordingly, the respective protruded portions 21*b* of the scan electrode 21 are disposed in the pair of discharge cells on the respective even-numbered vertical barrier ribs 16*a*.

Figure 6:
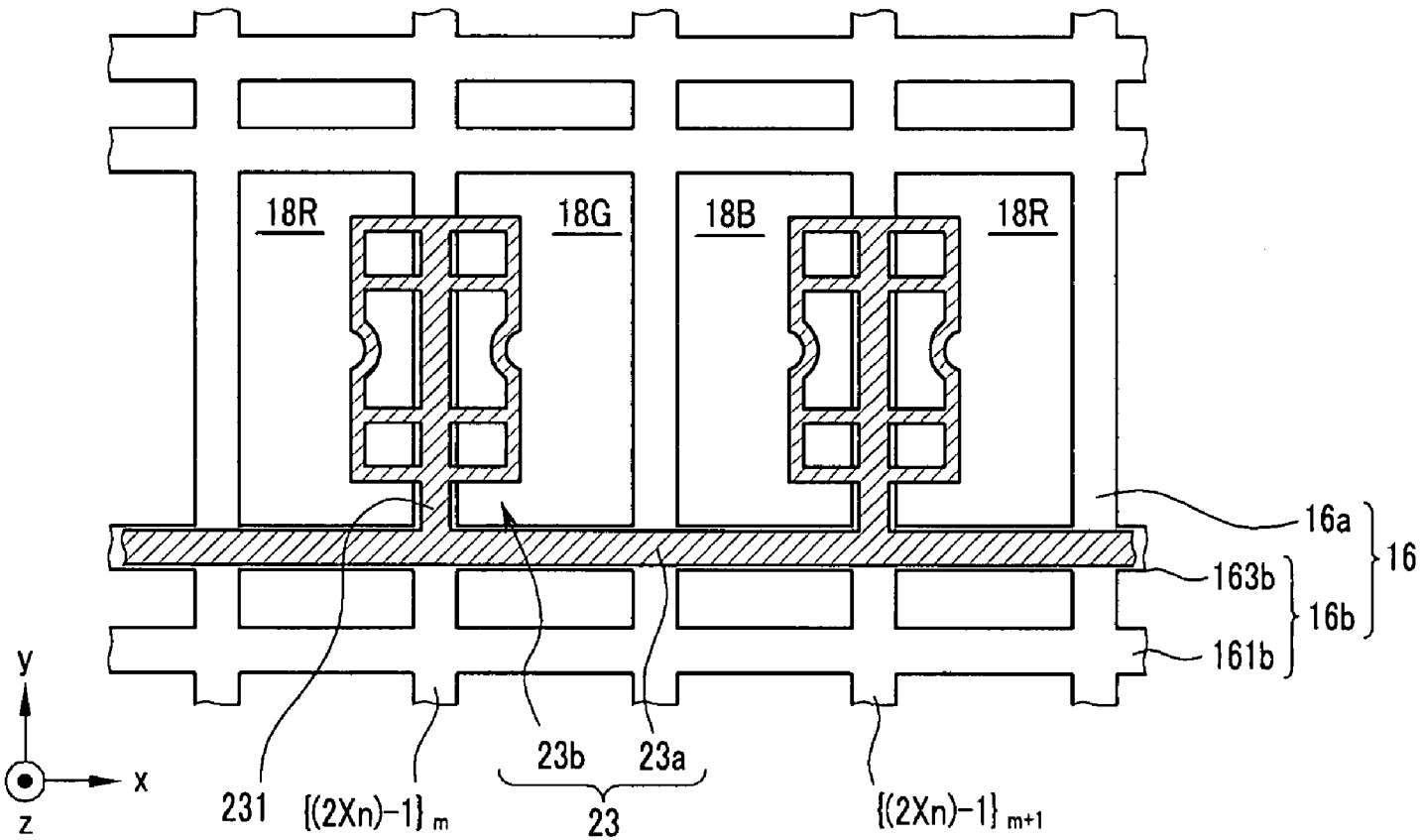
FIG. 6 is a plan view illustrating the positional relationship between the barrier ribs and the sustain electrodes of the first embodiment.

FIG. 6 is a diagram illustrating the structure in which protruded portions of a sustain electrode are disposed along an odd-numbered vertical barrier ribs.

As shown in FIG. 6, the sustain electrode 23 is disposed at an opposite side to the scan electrode 21 on the respective discharge cells.

The linear portion 23*a* constituting the sustain electrode 23 is disposed immediately above a horizontal barrier rib 163*b* at an opposite side to a horizontal barrier rib 161*b* on which the linear portion 21*a* of the scan electrode 21 is formed. Further, the first portion 231 of the protruded portion 23*b* is disposed immediately above a vertical barrier rib 16*a*.

Accordingly, the sustain electrode 23 is disposed in the discharge cell such that the protruded portions 23*b* thereof are respectively protruded to a pair of adjacent discharge cells in the extension direction of the horizontal barrier rib 16*b*.

In addition, a plurality of respective protruded portions 23*b* are formed to extend from the linear portion 23*a* corresponding to the odd-numbered vertical barrier ribs 16*a*. Accordingly, the respective protruded portions 23*b* of the sustain electrode 23 are disposed in the pair of the discharge cells on the respective odd-numbered vertical barrier ribs 16*a*.

As such, the protruded portions 21*b* of the scan electrode 21 are disposed along the even-numbered vertical barrier ribs 16*a* and the protruded portions 23*b* of the sustain electrode 23 are disposed along the odd-numbered vertical barrier ribs 16*a* at the opposite side of the respective discharge cells. Therefore, the protruded portions 21*b* and 23*b* of the sustain electrode and the scan electrode are alternately disposed in the extension direction of the horizontal barrier rib 16*b* and face each other in the discharge cell to form the discharge gap G.

As described above, the scan electrode 21 and the sustain electrode 23 are protruded to the discharge cells in left and right directions on (or above) the vertical barrier ribs 16*a*. Therefore, as shown in FIG. 2, in a discharge cell structure in which a first pitch P1 between a pair of the horizontal barrier ribs 16*b* that define the discharge cells 18 is longer than a second pitch P2 between a pair of the vertical barrier ribs 16*a* that define the discharge cells 18, the discharge gap G is formed along the first pitch P1 which is relatively long.

As such, in the PDP of the present embodiment, the discharge gap G is formed over the wide area of the discharge cell, and thus the discharge is fired throughout the discharge cell, thereby realizing low-voltage driving and enhancing the emission luminance.

On the other hand, as shown in FIGS. 3 and 4, as regards the protruded portions 21*b* and 23*b* of the scan electrode 21 and the sustain electrode 23, first concave portions C1 (each having a groove shape of a predetermined curvature) are formed in the first electrode portions 213*a* and 233*a* facing each other.

Accordingly, the discharge gap G has a long gap G2 on the basis of the first concave portions C1 and a short gap G1, being shorter than the long gap G2, in a portion where the first concave portions C1 are not formed.

In more detail, the protruded portions 21*b* and 23*b* have the first concave portions C1, respectively, and the discharge gap G includes the long gap G2 and the short gap G1. Thus, with a discharge mechanism in which the discharge is fired from the short gap G1 and spreads throughout the discharge cell through the long gap G2, the discharge is concentrated at the center by the first concave portions C1 constituting the long gap G2, such that the discharge occurs stably. Further, since a discharge firing voltage can be reduced in the portion of the short gap G1, where the first concave portions C1 are not formed, the discharge efficiency can be increased.

Figure 7:
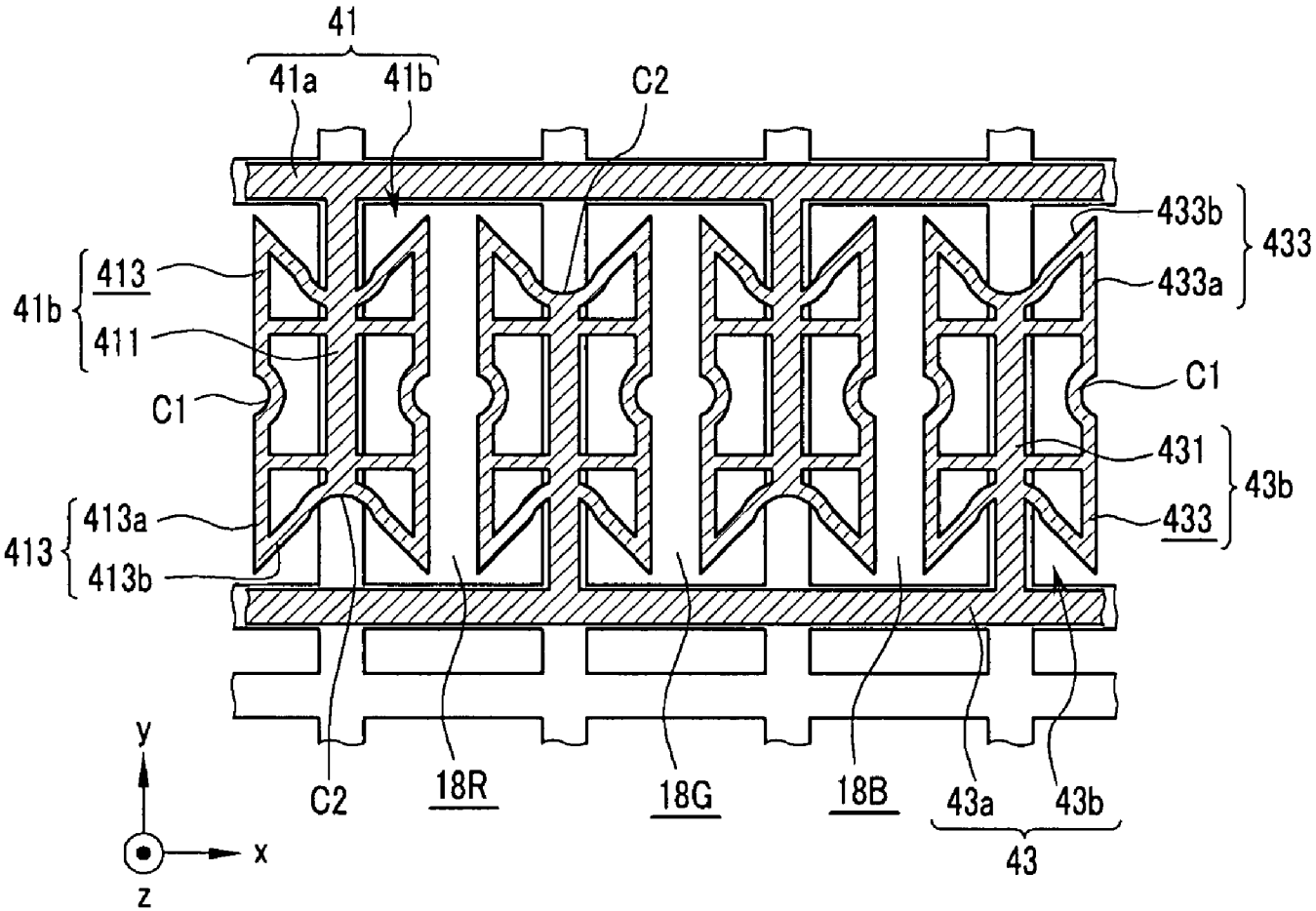
FIG. 7 is a plan view illustrating the positional relationship between display electrodes and barrier ribs according to a second embodiment of the present invention.

FIG. 7 is a plan view illustrating the positional relationship between display electrodes and barrier ribs according to a second embodiment of the present invention.

A scan electrode 41 (having a linear portion 41*a* and a protruded portion 41*b*) and a sustain electrode 43 (having a linear portion 43*a* and a protruded portion 43*b*) of the second embodiment also have substantially the same configurations as described above, except that second concave portions C2 are formed in second electrode portions 413*b* and 433*b*, respectively.

The second concave portions C2 are in one embodiment connected to ends of first portions 411 and 431, respectively. Further, the second electrode portions 413*b* and 433*b* of second portions 413 and 433 may obliquely connect first electrode potions 413*a* and 433*a* of the second portions 413 and 433 to the first portions 411 and 431, respectively.

Figure 8:
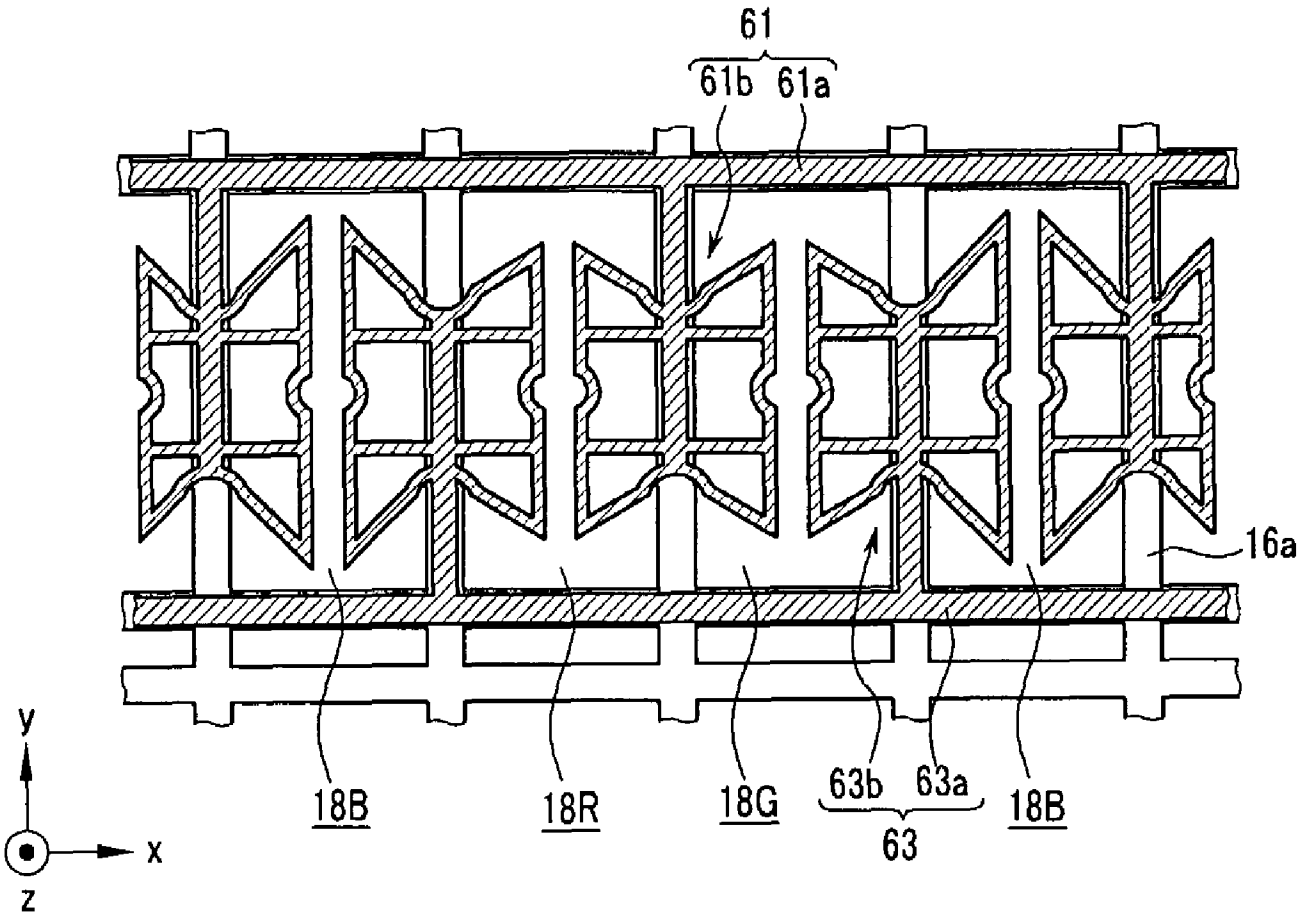
FIG. 8 is a plan view illustrating the positional relationship between display electrodes and barrier ribs according to a third embodiment of the present invention.

FIG. 8 is a plan view illustrating the positional relationship between display electrodes and barrier ribs according to a third embodiment of the present invention.

The discharge cells 18 are divided into the red discharge cells 18R, the green discharge cells 18G, and the blue discharge cells 18B according to the colors represented by the phosphor layer coated on the respective discharge cells 18.

Also, as similar to the first and second embodiments described above, a scan electrode 61 and a sustain electrode 63 have linear portions 61*a* and 63*a* and protruded portions 61*b* and 63*b*, respectively. The protruded portions 61*b* and 63*b* are disposed in a pair of adjacent discharge cells on the respective vertical barrier ribs 16*a*.

In the third embodiment, in order to reduce the difference in luminance by colors of the discharge cells, the protruded portions 61*b* and 63*b* formed corresponding to the discharge cell for one color are formed to be larger than the protruded portions 63*a* and 63*b* disposed in the discharge cells for the other colors.

As an example, in FIG. 8, the protruded portions 61*b* and 63*b* disposed in the blue discharge cell 18B are formed to be larger than the protruded portions disposed in the red discharge cell 18B and/or the green discharge cell 18G.

As such, if the protruded portions disposed in the blue discharge cell 18B are formed to be larger than the protruded portions disposed in the discharge cells for other colors, the discharge occurring in the blue discharge cell 18B can be used throughout the discharge cells for other colors. As a result, the emission luminance can be improved, as compared to the related art.

In a PDP of the present invention, horizontal barrier ribs and vertical barrier ribs define a plurality of discharge cells and display electrodes being relatively long are formed to be protruded from the vertical barrier ribs. As such, the discharge area can be increased, as compared to the structure according to the related art, thereby realizing low-voltage driving and enhancing emission luminance. Further, since the display electrodes are protruded into the discharge cells from the vertical barrier ribs, the size of the discharge area (e.g., the discharge area of a particular discharge cell of a particular color) can be easily adjusted to thereby further enhance the emission luminance and the color temperature. Further, a margin for the address voltage can be sufficiently secured. In addition, since a display electrode is made of a metal electrode having high conductivity, the discharge firing voltage can be reduced. Further, according to the present invention, since the display electrode is made of a non-transmissive metal electrode and is formed immediately above the barrier rib, the reflection of light toward outside can be reduced and thus the contrast can be enhanced.

While this invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A plasma display panel comprising:

a front substrate and a rear substrate facing each other and forming a space therebetween;

a plurality of barrier ribs defining a plurality of discharge cells in the space formed between the front substrate and the rear substrate;

a plurality of address electrodes extending in a first direction to intersect the discharge cells;

a plurality of phosphor layers respectively within the discharge cells; and a plurality of first electrodes and a plurality of second electrodes having linear portions formed in a second direction to intersect the first direction and a plurality of protruded portions extending in the first direction from the linear portions, the protruded portions:

having openings within a periphery of the protruded portions, and facing each other in the second direction within the discharge cells so as to form a plurality of discharge gaps, respectively.

2. The plasma display panel of claim 1, wherein each of the protruded portions of the first electrodes and the second electrodes has a first portion extending in the first direction from the linear portion and a second portion extending to a pair of adjacent discharge cells in the second direction from the first portion.

3. The plasma display panel of claim 2, wherein the barrier ribs have a plurality of vertical barrier ribs in the first direction and a plurality of horizontal barrier ribs in the second direction, and the first portions of the protruded portions are above the vertical barrier ribs, respectively.

4. The plasma display panel of claim 3, wherein the linear portions of the first electrodes and the second electrodes are above the horizontal barrier ribs, respectively.

5. The plasma display panel of claim 2, wherein the second portion of one of the protruded portions has a first electrode portion spaced apart from the first portion thereof and forming a respective one of the discharge gaps together with the second portion of another one of the protruded portions opposing the one of the protruded portions within a respective one of the discharge cells and wherein the second portion of the one of the protruded portions also has a second electrode portion connecting the first electrode portion to the first portion thereof.

6. The plasma display panel of claim 5, wherein an end of the first portion of the one of the protruded portions is connected to the second electrode portion of the second portion thereof.

7. The plasma display panel of claim 5, wherein the first electrode portion of the second portion of the one of the protruded portions has a first concave portion by which the respective one of the discharge gap is formed into a first gap and a second gap having different sizes.

8. The plasma display panel of claim 5 wherein the first electrode portion comprises a pair of first electrode portions and wherein the second portion of the one of the protruded portions has a rib connecting the pair of first electrode portions, respectively formed in the pair of adjacent discharge cells in the second direction, to each other.

9. The plasma display panel of claim 8, wherein the rib comprises a pair of ribs in the second portion of the one of the protruded portions.

10. The plasma display panel of claim 1, wherein the protruded portions of the first electrodes and the protruded portions of the second electrodes are alternately formed in the second direction.

11. The plasma display panel of claim 1, wherein each of the linear portions is made of a metal.

12. The plasma display panel of claim 1, wherein each of the protruded portions is made of a metal.

13. A plasma display panel comprising:

a front substrate and a rear substrate facing each other and forming a space therebetween;

a plurality of barrier ribs defining a plurality of discharge cells in the space formed between the front substrate and the rear substrate;

a plurality of address electrodes extending in a first direction to intersect the discharge cells;

a plurality of phosphor layers respectively within the discharge cells; and a plurality of first electrodes and a plurality of second electrodes having linear portions formed in a second direction to intersect the first direction and a plurality of protruded portions extending in the first direction from the linear portions, the protruded portions facing each other in the second direction within the discharge cells so as to form a plurality of discharge gaps, respectively, wherein each of the discharge cells has a respective one of the phosphor layers representing one of first, second, and third colors and wherein the protruded portions of the first electrodes and the second electrodes corresponding to the discharge cells having the phosphor layer representing one of the colors are larger than the protruded portions corresponding to other discharge cells representing other colors.

14. The plasma display panel of claim 13, wherein the protruded portions corresponding to the discharge cells of the first color are larger than the protruded portions corresponding to the discharge cells of the second color and the third color.

15. The plasma display panel of claim 14, wherein the protruded portions corresponding to the second color and the third color have substantially the same size.

16. The plasma display panel of claim 14, wherein the first color is blue.

17. The plasma display panel of claim 13, wherein the first color, the second color, and the third color are blue, green, and red, respectively.

18. The plasma display panel of claim 5, wherein the first electrode portion of the second portion of the one of the protruded portions has a first concave portion and wherein the second electrode portion of the second portion of the one of the protruded portions has a second concave portion that is concaved inward.

19. The plasma display panel of claim 18, wherein the second concave portion is connected to the end of the first portion of the one of the protruded portions.

20. The plasma display panel of claim 19, wherein the second concave portion is connected to the end of the first portion of the one of the protruded portions obliquely.

21. The plasma display panel of claim 5, wherein the second electrode portion of the second portion of the one of the protruded portions obliquely connects the first electrode portion of the second portion of the one of the protruded portions to the first portion of the one of the protruded portions.

* * * * *